US006298994B1

(12) United States Patent
Debrunner et al.

(10) Patent No.: US 6,298,994 B1
(45) Date of Patent: Oct. 9, 2001

(54) HEXAGONAL SHIPPING CONTAINER SYSTEM

(75) Inventors: Kurt Debrunner, Richmond; Patrick J. Nash, Midlothian, both of VA (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 09/439,014

(22) Filed: Nov. 12, 1999

(51) Int. Cl.[7] ..... B65D 19/06

(52) U.S. Cl. ..... 206/600; 206/459.5; 229/122; 229/199

(58) Field of Search ..... 206/386, 459.1, 206/459.5, 597, 599, 600; 229/122, 198.2, 198.3, 199, 918

(56) References Cited

U.S. PATENT DOCUMENTS

| | | | | |
|---|---|---|---|---|
| 3,129,868 | * | 4/1964 | Jenk | 206/586 |
| 3,650,459 | * | 3/1972 | Tucker | 206/600 |
| 3,770,186 | * | 11/1973 | Kupersmit | 206/599 |
| 4,238,040 | * | 12/1980 | Fitzpatrick | 215/11.3 |
| 4,413,737 | * | 11/1983 | Wind | 206/599 |
| 4,850,506 | * | 7/1989 | Heap, Jr. et al. | 206/386 |
| 4,930,661 | * | 6/1990 | Voorhies | 206/386 |
| 5,020,674 | * | 6/1991 | Thorud et al. | 206/600 |
| 5,651,463 | * | 7/1997 | Major et al. | 206/599 |
| 5,829,595 | * | 11/1998 | Brown et al. | 206/600 |
| 6,000,549 | * | 12/1999 | Perkins | 206/600 |
| 6,032,815 | * | 3/2000 | Elstone | 206/600 |

OTHER PUBLICATIONS

System Octabin Containers Technical Information Sheet (and 7 sheets of drawings) designed by Crown Obrist AG of Reinach, Switzerland (date unknown).

Drawing sheet for Crown–Sandston shipping container manufactured by Crown Cork & Seal of Philadelphia, PA (date unknown).

"Molding the future of returnable plastic pallets" brochure from Menasha Corporation of Watertown, Wisconsin featuring plastic Convoy® Opte–Pak™ Pallets date of brochure unknown (Convoy® Opte–Pak™ Pallets from 1987).

* cited by examiner

*Primary Examiner*—Jim Foster
(74) *Attorney, Agent, or Firm*—Woodcock Washburn Kurtz Mackiewicz & Norris LLP

(57) ABSTRACT

A shipping container for storing, transporting, and dispensing contents has two pallets, a base pallet and a cover pallet, and a plurality of sidewalls that are situated between the base pallet and the cover pallet. One sidewall has a side opening for dispensing at least a portion of the contents from the side opening. The sidewalls also can be removed from the pallets and folded substantially flat, rendering the container collapsible. Preferably, the sidewalls of the container comprise a rear sidewall, a front sidewall, two side sidewalls, each extending between the front sidewall and the rear sidewall, and two inserts, each extending the height of the container and extending between a location on the front sidewall and a location on a closer side sidewall, yielding an interior volume having a hexagonal cross-sectional shape. Additionally, the container preferably comprises a plurality of cut-outs in a sidewall situated, each cut-out situated at different heights on the sidewall to visibly indicate the type and current level of contents in the container. When the container is in its collapsed state, the front sidewall is in a horizontal position and situated below the inserts, which are situated below the side sidewalls, which are situated below the rear sidewall.

20 Claims, 6 Drawing Sheets

HEXAGONAL SHIPPING CONTAINER SYSTEM

The present invention relates to the field of shipping containers, and more particularly shipping containers for shipping, storing and dispensing large volumes of relatively small items, such as plastic container closures.

BACKGROUND OF THE INVENTION

Shipping containers are well known. Most commonly, such containers are rather large, heavy and sturdy to carry their contents safely. Shipping containers are required to be heavy-duty packaging systems to safely transport a large quantity of contents or items from various modes of transportation such as cargo ships, plains, trains, and large trucks. During transport, these containers are often moved about on pallets, designed to be engaged by fork lift machinery.

One conventional shipping container is a "System Octabin Container," designed by Crown Obrist AG of Reinach, Switzerland. As the name implies, the Octabin container has an octagonal cross-sectional shape, has a capacity of 1.5 cubic meters and is used to transport closures (or caps) for plastic containers, among other items. The Octabin container has an opening on the bottom of one side to dispense closures from the side as well as from the top of the container, where it is usually loaded. The Octabin container, however, has several drawbacks.

First, the Octabin container is not collapsible. Because these containers are so large, it is desirable to have a container that collapses so that it can be stored or shipped easily when empty, requiring relatively little space. Second, the Octabin container is not stackable. Again, for storing and transport purposes, it is highly desirable to have shipping containers that stack or mate with one another, requiring less space and making the containers more stable when shipped or stored. The third drawback is a result of the first two drawbacks. Because the Octabin container is neither collapsible nor stackable, these deficiencies render it non-returnable. A shipping container that can be returned to the manufacturer simply reduces waste by making the container "recyclable," thereby reducing the cost to the manufacturer, a savings which can be passed on to the customer.

Another conventional shipping container for transporting small items such as closures is a "Crown-Sandston" shipping container, manufactured by Crown Cork & Seal of Philadelphia, Pa. This shipping container has a rectangular cross-section and while it is collapsible and stackable, it does not allow for unloading from the side. It necessitates loading and unloading from the top of the container only.

Thus, it is desirable to provide a shipping container that is collapsible, stackable, returnable, and allows for unloading of its contents by way of a side as well as the top. In providing such container, it also is desirable to make such a container more efficient.

SUMMARY OF THE INVENTION

A new and improved shipping container for storing, transporting, and dispensing contents is provided. The container comprises two pallets, a base pallet serving as a base of the container and a cover pallet serving as a cover of the container, and a plurality of sidewalls that are situated between the base pallet and the cover pallet.

One sidewall has a side opening for dispensing at least a portion of the contents from the side opening. In addition, the sidewalls can be removed from the pallets and folded substantially flat, rendering the container collapsible. As is conventional, when the cover pallet of the container is removed from the erect container, a top opening of the container is revealed for the loading or unloading of contents.

Preferably, the sidewalls of the container comprise a rear sidewall, a front sidewall, two side sidewalls, each extending between the front sidewall and the rear sidewall, and two inserts, each extending the height of the container and extending between a location on the front sidewall and a location on a closer side sidewall, yielding an interior volume having a hexagonal cross-sectional shape. For each insert, the location on the closer side sidewall is at a location closer to the front sidewall than the rear sidewall, and the locations on the front sidewall are the same distance from their respective closer sidewalls. Preferably, a spout for dispensing contents through the side opening, which preferably is a side opening in the front sidewall, is formed by the two inserts and the front sidewall.

In preferred embodiments, at least one sidewall further comprises at least one cut-out visibly indicating the type and current volume of contents in the container. Preferably, there are plurality of cut-outs in the sidewall, wherein the cut-outs are situated at different heights on the sidewall of the container. In certain preferred embodiments, the cut-outs are situated on the front sidewall and the rear sidewall.

When the container is in its collapsed state, the front sidewall is in a horizontal position and situated below the inserts, which are situated below the side sidewalls, which are situated below the rear sidewall. As is conventional, when the pallet is in its collapsed state, the base pallet and the cover pallet fit together relatively flat.

DETAILED DESCRIPTION OF THE PREFERRED EMBODIMENTS

A new and improved shipping container is provided. The new container is particularly useful for transporting a large quantity of small items such as closures or caps for plastic containers.

Figure 1:
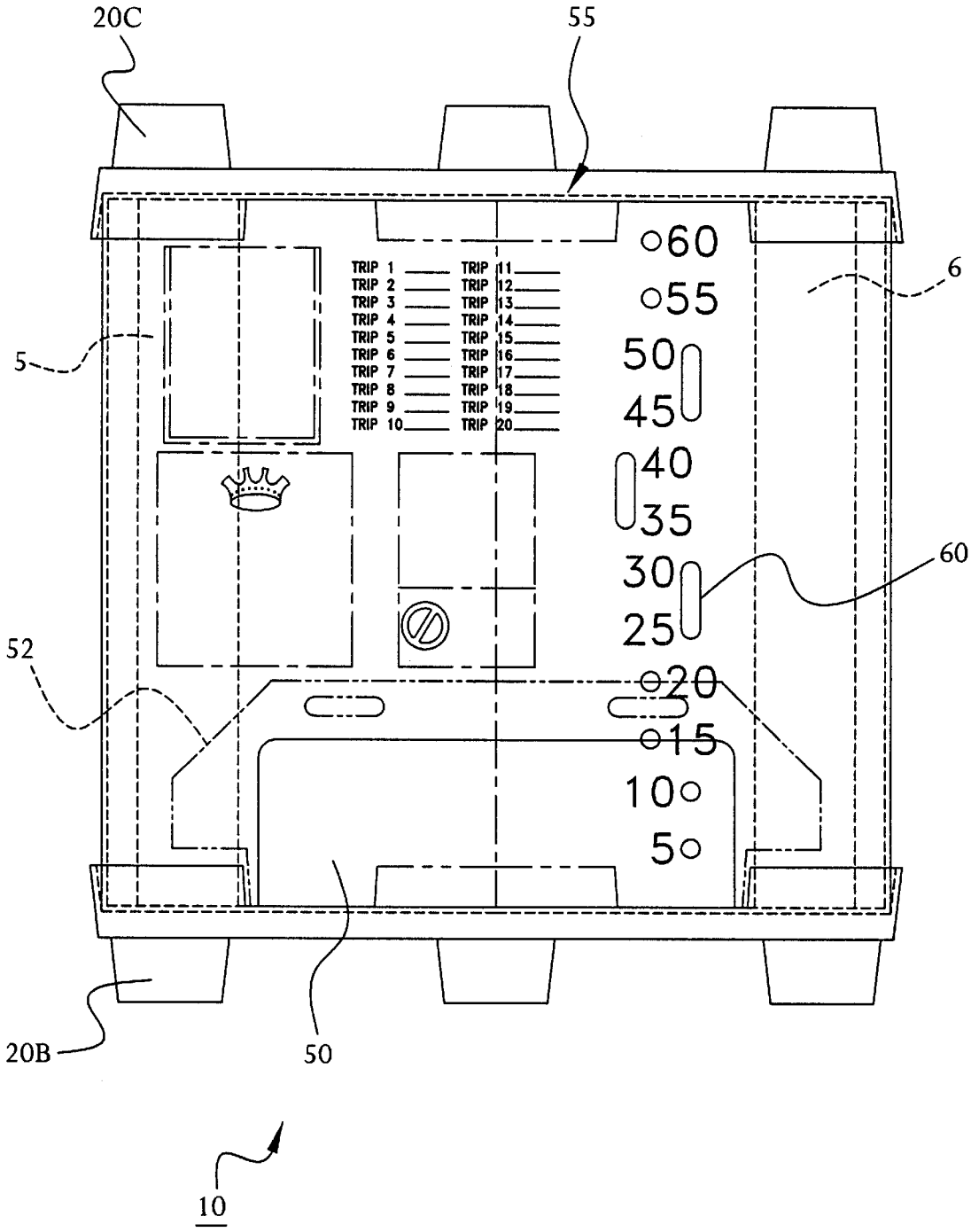
FIG. 1 is a front view of a preferred embodiment of a shipping container according to the present invention.

Shown in FIG. 1 is a front view of a preferred embodiment of a shipping container 10 according to the present invention. This new shipping container 10, referred to as a "Hexabin container," comprises a plurality of sidewalls 1–6 and a two pallets 20, a base pallet 20B serving as the base of the container 10 and a cover pallet 20C serving as the cover of the container 10.

Figure 2:
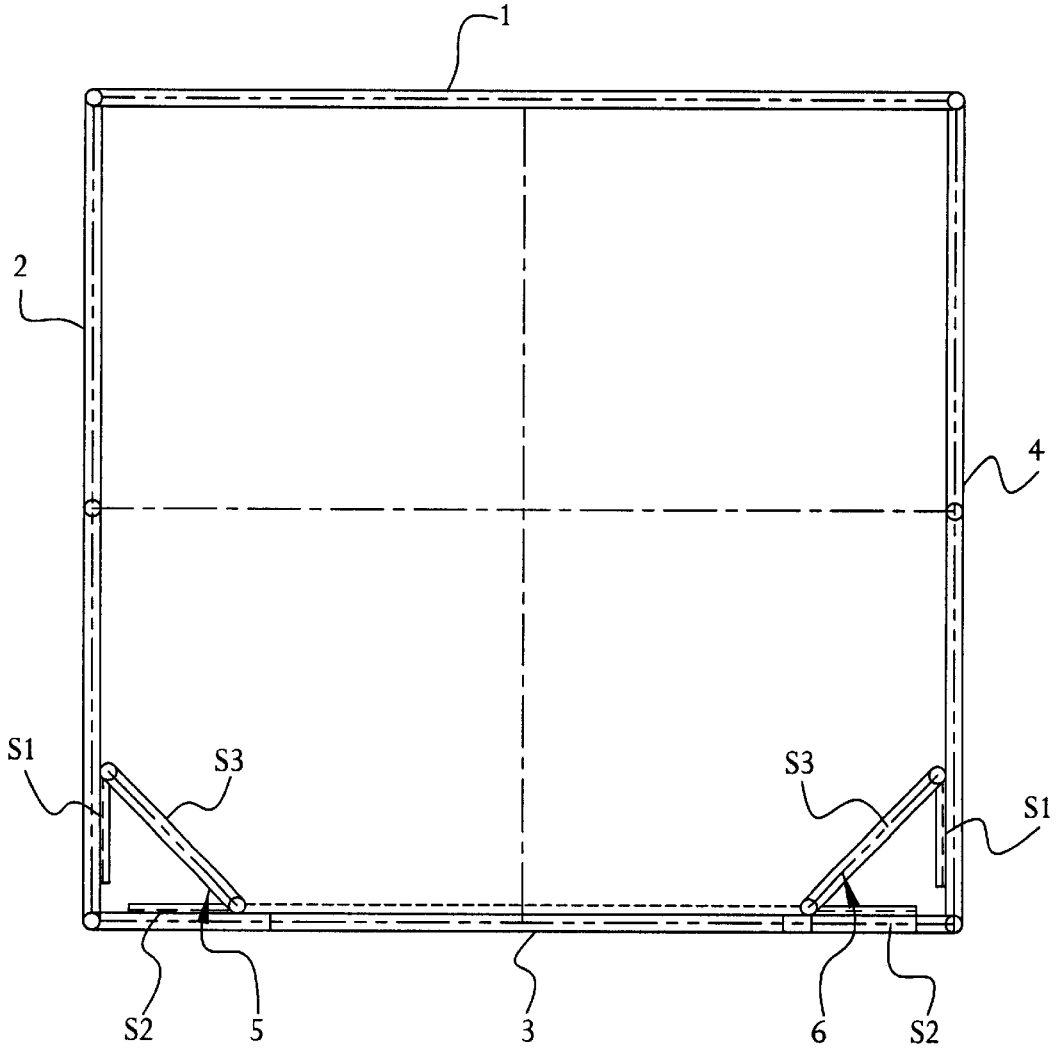
FIG. 2 is a top view of the shipping container of FIG. 1.

FIG. 2 shows a top view of the shipping container of FIG. 1 without the pallets 20. The Hexabin container 10, or shipping system, has four exterior walls 1–4, but six interior walls 1–6, giving the intended interior volume a hexagonal cross-sectional shape. The sidewalls of the Hexabin container 10 comprise a rear sidewall 1, two side sidewalls 2 and 4, a front sidewall 3, and two inserts 5 and 6, referred to as hexabin inserts. As shown, the hexabin inserts 5 and 6 are oriented at approximately 45 degrees to the front sidewall 3 and their respective closest side sidewall 2 and 4.

With the hexabin inserts 5 and 6 in place, the hexabin container 10 assumes its hexagonal cross-sectional shape. Each insert 5 or 6 comprises 3 folding sections, two end sections S1 and S2, and a diagonal section S3. One end section S1 lies flat against the respective side sidewall 2 or 4 and the other end section S2 lies flat against the front sidewall 3 so that diagonal section S3 serves as a interior wall of the container 10.

When the container 10 is in the position of FIG. 2, the inserts 5 and 6 are held in place by a small interference in the base pallet 20 B (as well as an interference in the cover pallet 20C when covered). A bag, preferably a plastic bag, also is used to hold the contents and line the interior of the container 10 and applying slight pressure against the inserts 5 and 6, helping to hold them in place. End sections S2 of inserts 5 and 6 also are mounted to the front sidewall 3, usually with an adhesive such as glue. Additionally, a good fold on the inserts 5 and 6 helps them keep their intended position.

Figure 3:
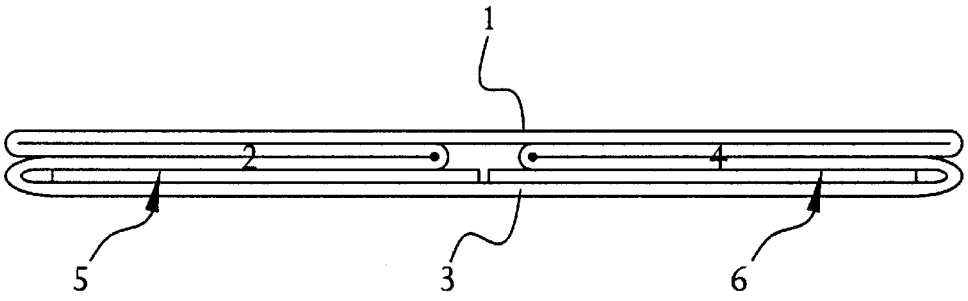
FIG. 3 is a top view of the sidewalls of the container of FIG. 1 when the sidewalls are in a folded position.

FIG. 3 shows a top view of the sidewalls 1–6 of the Hexabin container 10 when the sidewalls are in a folded position. To achieve the position of FIG. 3, the hexabin container 10 must be disassembled. First, the sidewalls 1–6 are removed from both the base portion 20B and the cover portion 20C of the pallet 20, to which they were inserted and attached. Second, the sidewalls 1–6 are rotated until front sidewall 3 is situated on the bottom of the others, as shown in FIG. 2. Third, the hexabin inserts 5 and 6 are removed from their respective side sidewalls 2 and 4 and folded inward, toward each other until they rest flat against front sidewall 3. Fourth, side sidewalls 2 and 4 are folded at their respective mid-points until they rest flat on top of the hexabin inserts 5 and 6. As step four is performed, rear sidewall 1 comes down to rest against the side sidewall 2 or 4 which is resting on top of the other. When disassembly is complete, the sidewalls 1–6 should lie substantially flat in a compressed state, as shown in FIG. 3.

Figure 4:
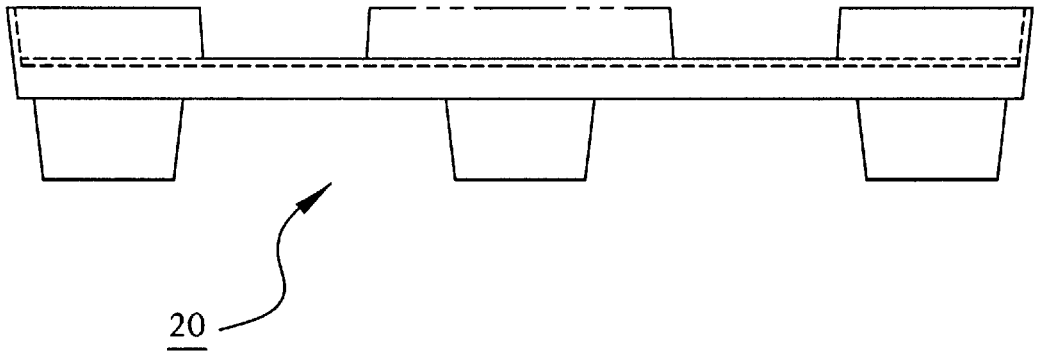
FIG. 4 is a view of a pallet that is used in the container of FIG. 1.
Figure 5:
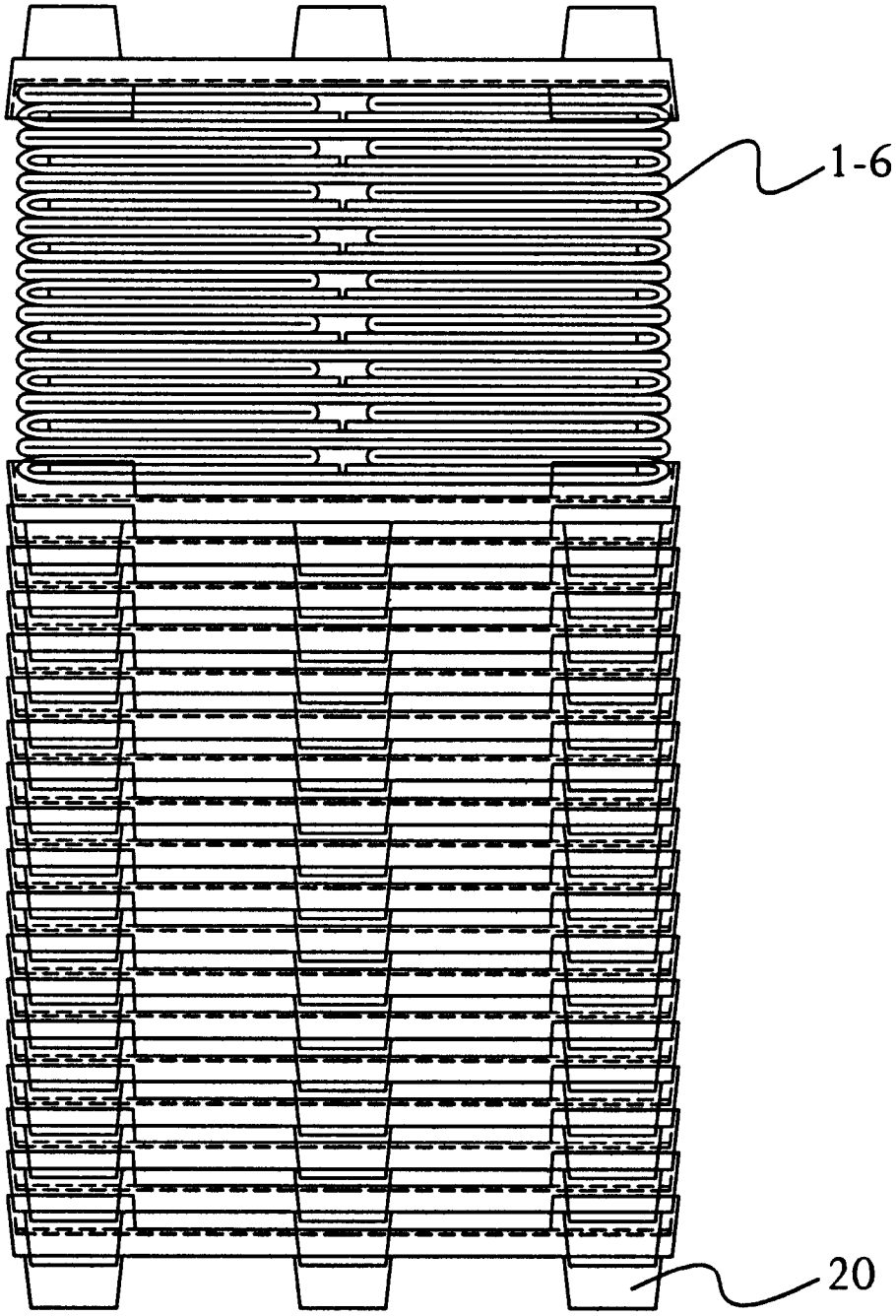
FIG. 5 is a front view of a stack of sidewalls of the container of FIG. 1 when the sidewalls of each container are in a folded position, along with a stack of pallets.

FIG. 4 shows a view of a pallet 20 that is used in the container of FIG. 1. The pallet 20 oriented as shown in FIG. 4 is a base pallet 20B. FIG. 5 shows a front view of a stack of sidewalls 1–6 of ten Hexabin container 10 when the sidewalls 1–6 of each container 10 are in a folded position. Beneath this stack of sidewalls 1–6, are shown a stack of 19 pallets 20. As shown, this stack of pallets 20 are oriented as base pallets 20B, and fit together relatively flat, as is conventional. Above the stack of sidewalls 1–6 is a pallet 20, oriented as a cover pallet 20C. The position of these 10 Hexabin shipping container systems as shown in FIG. 5 is the desired position for return shipping or for storage.

Figure 6:
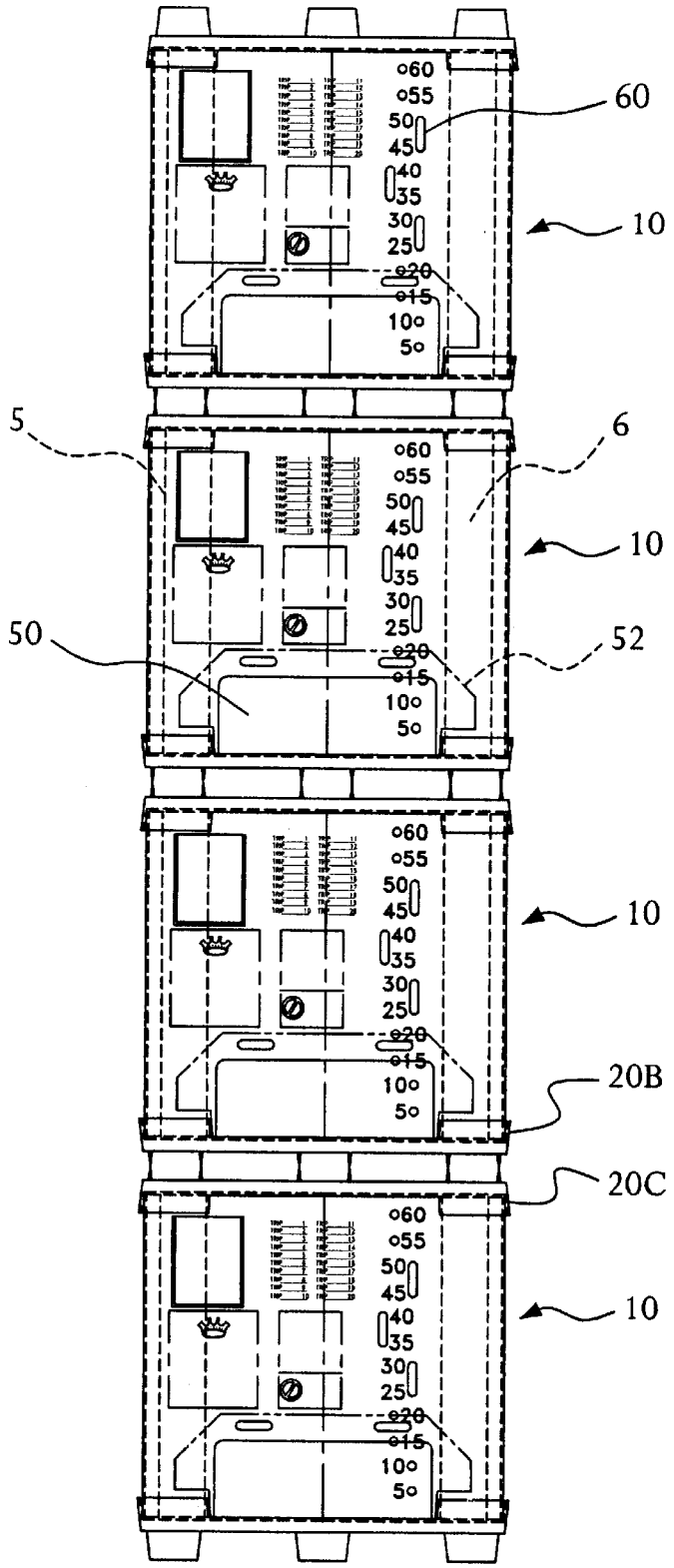
FIG. 6 is an front view of two shipping containers of FIG. 1 in a loaded stacked position.

FIG. 6 is an front view of four Hexabin shipping containers of FIG. 1 in a stacked position. As shown, a cover pallet 20C is designed to receive a base pallet 20B so that the Hexabin containers 10 can be stacked for storage. Storage in this fashion usually means storage of the contents as well because if empty, the Hexabin containers 10 require less space if stored collapsed than stacked as shown in FIG. 5.

The preferred embodiment of the Hexabin container 10 of FIG. 1 has an interior volume of approximately 70,000 $in^3$ for holding approximately 68,000 closures weighing approximately 470 lbs. A Hexabin container 10 with such capacity has front and rear sidewalls 1 and 3 of approximately 46 inches wide and side sidewalls 2 and 4 of approximately 43 inches wide. The hexabin inserts 5 and 6 are approximately 10 inches wide and each sidewall 1–6 is approximately 42 inches high. Preferably, the Hexabin container 10 is made of a corrugated material such as paper or plastic. In addition, the preferred pallets 20 used in the Hexabin container 10 are plastic Convoy® Opte-Pak™ Pallets, manufactured by Menasha Corporation of Watertown, Wis.

In the preferred embodiment of the Hexabin container 10 of FIG. 1, there is a side opening 50 in the front sidewall 3, i.e., the sidewall 3 to which both hexabin inserts 5 and 6 are mounted. For the preferred container 10 described above, the side opening 50 is approximately 28 inches wide and approximately 10 inches high. The side opening 50 provides for facilitating unloading of the contents so that contents can be unloaded from either the top or the side of the container 10.

To facilitate emptying of contents from the top opening 55, the Hexabin container 10 is tilted forward approximately 135 degrees. In similar fashion, the container 10 is tilted forward approximately 45 degrees to facilitate emptying of the contents from the side opening 50 to form a spout formed by the hexabin inserts 5 and 6 and the front sidewall 3 between the inserts 5 and 6.

The hexabin inserts 5 and 6 of the present invention also serve to strengthen the front and side sidewalls 2–4, particularly during stacking of container 10. When unloading from the front sidewall 3 will not be required, however, the hexabin inserts 5 and 6 can be rotated toward each other until they rest flat against the front sidewall 3. This position of the inserts 5 and 6 may be maintained throughout shipping, conventional unloading through the top, and return. When used in this manner, the inserts 5 and 6 act to strengthen the front sidewall 3 for stacking of containers 10.

When not using the front opening 50 such as during shipment, a flap 52 attached to the bottom of front sidewall 3 covers the opening 50. The flap is generally trapezoidal in shape. When unloading from the front opening 50 is required, the flap 52 is rotated downward so that it rests against the base portion 20B of the pallet 20. All of the contents can be removed through either the side opening 50 or through the top opening 55.

An additional feature of the Hexabin container 10 of the present invention is that it has cut-outs 60 in the front or rear sidewalls 3 and 1, which indicate the type and level of contents in the container 10 at a given time. These cut-outs 60 are shown in FIG. 1 and preferably, have markings adjacent each cut-out 60 to indicate the exact volume level. For example, in the preferred container described above and shown in FIG. 1, if one sees contents through the cut-out 60 at the "50" level, but not at the "55" level, then there are at least 50,000 $in^3$, but less than 55,000 $in^3$ of contents in the container 10. This feature of the present invention is a great advantage when removing the lid and looking into a container is difficult, such as when containers 10 are stacked on each other.

As disclosed in the preceding paragraphs, the Hexabin container 10 of the present invention provides a new and improved shipping container that is collapsible, stackable, returnable, and allows for unloading of its contents by way of a sidewall as well as the top. In addition, the hexabin inserts 5 and 6 provide for pouring of contents through a spout formation at the side of the container 10 and serve to strengthen the container 10 so that it can withstand stacking, particularly with an opening in the sidewall to which the inserts 5 and 6 contact and reinforce. The indicator cut-outs 60 also make the container 10 more efficient by enabling one to know the type and level of contents in a given container without resorting to the conventional way of looking through the top.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

What is claimed is:

1. A shipping container for storing, transporting and dispensing contents, the container comprising:

a base pallet serving as a base of the container and a cover pallet serving as a cover of the container; and a plurality of foldably connected sidewalls that are situated between the base pallet and the cover pallet, the sidewalls comprising:

a rear sidewall;

a front sidewall having an opening therein for dispensing at least a portion of the contents;

two side sideways, each extending between the front sidewall and the rear sidewall; and two inserts, each extending the height of the front sidewall, foldably attached to an inner surface of the front sidewall and extending to a closer side sidewall, each insert disposed at an oblique angle to the front sidewall and disposed at an oblique angle to the closer side sidewall, and adapted to be moved away from the closer side sidewall to a position along the front sidewall;

wherein the sidewalls can be removed from the pallets and each one of the rear sidewall and front sidewall are foldably connected to the side sidewalls such that the sidewalls are capable of being folded substantially flat, thereby rendering the container collapsible.

2. The container of claim 1, wherein the cover pallet of the container may be removed from said erect container, revealing a top opening of the container so that the contents can be loaded or unloaded from the top opening.

3. The container of claim 1, wherein for each insert, the location on the closer side sidewall is at a location closer to the front sidewall than the rear sidewall, and the locations on said front sidewall are the same distance from their respective closer sidewalls.

4. The container of claim 1, wherein at least one sidewall further comprises at least one cut-out visibly indicating the current volume of contents in the container.

5. The container of claim 4, wherein the at least one sidewall further comprises a plurality of cut-outs, wherein at least two cut-outs are situated at different heights on the at least one sidewall of the container.

6. The container of claim 5, wherein the cut-outs are situated on the front sidewall and the rear sidewall.

7. The container of claim 1, wherein when in its collapsed state, the front sidewall is flat and when the front sidewall is in a horizontal position, it is situated below the inserts, which are situated below the side sidewalls, which are situated below the rear sidewall.

8. The container of claim 1, wherein when in its collapsed state, the base pallet and the cover pallet fit together relatively flat.

9. The container of claim 5 further comprising markings on the at least one sidewall in which there are at least two cut-outs situated at different heights, wherein each marking is adjacent each cut-out and indicates a numerical volume of contents at the height of the respective cut-out.

10. container of claim 1, wherein the container has an interior and the interior has six sidewalls.

11. The container of claim 1, wherein when the container is in its container state, and the inserts are folded flat against the front sidewall so that the container has an interior which has four sidewalls.

12. The container of claim 1, wherein each insert is situated at an angle of approximately 45 degrees to the front sidewall and situated at approximately 45 degrees to the closer side sidewall.

13. The container of claim 1, wherein when the container is in its collapsed state, the front sidewall is flat and when the front sidewall is in a horizontal position, it is situated below the inserts, which are situated below the side sidewalls, which are situated below the rear sidewall.

14. The container of claim 13, wherein when the container is in its collapsed state, the inserts, the side sidewalls and the rear sidewall all are parallel to the front sidewall.

15. The container of claim 1, wherein each insert further comprises two folding end sections, each end section being connected to the insert, which serves as a middle section;

wherein when the container is in its container state, one end section is situated flat against its respective side sidewall and the other end section is situated flat against the front sidewall.

16. The container of claim 15, wherein when the container is in its container state, the end sections fold about their connections with the inserts and fold inwardly toward a corner where the front sidewall and side sidewall meet.

17. The container of claim 15, wherein when the container is in its collapsed state, the front sidewall is flat and when the front sidewall is in a horizontal position, it is situated below all sections of inserts, which all are extended flat and situated below the side sidewalls, which are situated below the rear sidewall so that all sections of the inserts, the side sidewalls and the rear sidewall all are parallel to the front sidewall.

18. The container of claim 1, wherein the two inserts form planar surfaces that enhance dispensing of at least a portion of the contents.

19. The container of claim 1, wherein in its collapsed state, the inserts are folded flat against the front sidewall and each of the two side sidewalls are folded at a fold line formed therein.

20. The container of claim 19, wherein the fold line is located at a mid-point between the front sidewall and the rear sidewall.

* * * * *

UNITED STATES PATENT AND TRADEMARK OFFICE

CERTIFICATE OF CORRECTION

PATENT NO. : 6,298,994 B1 
DATED : October 9, 2001
INVENTOR(S) : Kurt Debrunner and Patrick J. Nash It is certified that error appears in the above-identified patent and that said Letters Patent is hereby corrected as shown below:

Column 5,
Line 27, delete "sideways" and insert -- sidewalls -- therefor.

Column 6,
Line 12, insert -- The -- before "container".

Signed and Sealed this

Ninth Day of April, 2002

*Attest:*

*Attesting Officer*

JAMES E. ROGAN
*Director of the United States Patent and Trademark Office*